US010919719B1

(12) United States Patent
Tanaka

(10) Patent No.: US 10,919,719 B1
(45) Date of Patent: Feb. 16, 2021

(54) BELT DRIVING DEVICE AND TRANSFER DEVICE

(71) Applicant: FUJI XEROX CO., LTD., Tokyo (JP)

(72) Inventor: Daisuke Tanaka, Kanagawa (JP)

(73) Assignee: FUJI XEROX CO., LTD., Tokyo ( * ) Notice: Subject to any disclaimer, the term of this patent is extended or adjusted under 35 U.S.C. 154(b) by 0 days.

(21) Appl. No.: 16/853,958

(22) Filed: Apr. 21, 2020

(30) Foreign Application Priority Data

Oct. 21, 2019 (JP) ..... 2019-191938

(51) Int. Cl.
*B65H 5/02* (2006.01)
*G03G 15/16* (2006.01)

(52) U.S. Cl.
CPC ..... *B65H 5/02* (2013.01); *B65H 5/023* (2013.01); *B65H 5/025* (2013.01); *G03G 15/16* (2013.01); *B65H 2404/261* (2013.01); *B65H 2404/262* (2013.01); *B65H 2801/21* (2013.01); *G03G 2215/00143* (2013.01); *G03G 2215/00151* (2013.01)

(58) Field of Classification Search
CPC ..... B65H 5/02; B65H 5/021; B65H 5/025; B65H 2403/20; B65H 2404/261; B65H 2404/262; B65H 2404/2693; B65H 5/023; G03G 2215/00143; G03G 2215/00151; G03G 2215/00168
See application file for complete search history.

(56) References Cited

U.S. PATENT DOCUMENTS

2003/0175056 A1* 9/2003 Sato ..... G03G 15/1615 399/302
2009/0208241 A1* 8/2009 Takiguchi ..... G03G 15/162 399/101
2011/0150541 A1* 6/2011 Michibata ..... G03G 15/161 399/313
2016/0282770 A1* 9/2016 Seko ..... G03G 15/1615
2020/0095078 A1* 3/2020 Yamaki ..... G03G 15/65

FOREIGN PATENT DOCUMENTS

JP 2002-333779 A 11/2002
JP 2005-316257 A 11/2005

* cited by examiner

*Primary Examiner* — Prasad V Gokhale
(74) *Attorney, Agent, or Firm* — Sughrue Mion, PLLC

(57) ABSTRACT

A belt driving device includes an annular belt member, rotary members, a protrusion, and a contact member. The belt member includes first and second edges. The belt member is wound around the rotary members. The protrusion protrudes from an inner peripheral surface of the belt member. The protrusion and each rotary member are arranged in an extending direction of the rotary member. The protrusion is provided at the second edge. The contact member is closer to the first edge. When the belt member deviates, the contact member comes into contact with the belt member. A difference between a position of the belt member when the protrusion comes into contact with an end surface of one of the rotary members and a position of the belt member when the belt member comes into contact with the contact member is equal to or less than a width of the protrusion.

18 Claims, 7 Drawing Sheets

BELT DRIVING DEVICE AND TRANSFER DEVICE

CROSS-REFERENCE TO RELATED APPLICATIONS

This application is based on and claims priority under 35 USC 119 from Japanese Patent Application No. 2019-191938 filed Oct. 21, 2019.

BACKGROUND

1. Technical Field

The present disclosure relates to a belt driving device and a transfer device.

2. Related Art

There are devices in which an annular belt member is wound around plural rotary members and driven. In order to prevent positions where the belt member is wound on the rotary members from moving in a direction along shafts of the rotary members, some of the devices have such a configuration that a protrusion (for example, a rib) extending along an edge of the belt member is provided.

JP-A-2002-333779 discloses an image forming apparatus in which a transfer belt includes a rib in a circumferential direction at an end portion in a width direction in order to prevent the belt from shifting, and a stretch roller having the largest length, in the width direction, of a portion where the stretch roller is in contact with the transfer belt is a follower roller.

SUMMARY

Aspects of non-limiting embodiments of the present disclosure relate to preventing damage to a belt member caused by a protrusion riding on a rotary member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a belt driving device including: an annular belt member including a first edge and a second edge; plural rotary members that extend in parallel and rotate, the belt member being wound around the rotary members, the belt member circulating; a protrusion that protrudes from an inner peripheral surface of the belt member, the protrusion extending along the second edge of the belt member, the protrusion and each rotary member being arranged in an extending direction of the rotary member, the protrusion being provided at the second edge; and a contact member that is closer to the first edge than the second edge, the contact member and the belt member being arranged side by side, in which when the belt member deviates in the extending direction, the contact member comes into contact with the belt member to prevent the deviating of the belt member, and a difference between a position of the belt member when the protrusion comes into contact with an end surface of one of the rotary members and a position of the belt member when the belt member comes into contact with the contact member is equal to or less than a width of the protrusion in the extending direction.

BRIEF DESCRIPTION OF THE DRAWINGS

Exemplary embodiment(s) of the present disclosure will be described in detail based on the following figures, wherein.

DETAILED DESCRIPTION

Figure 1:
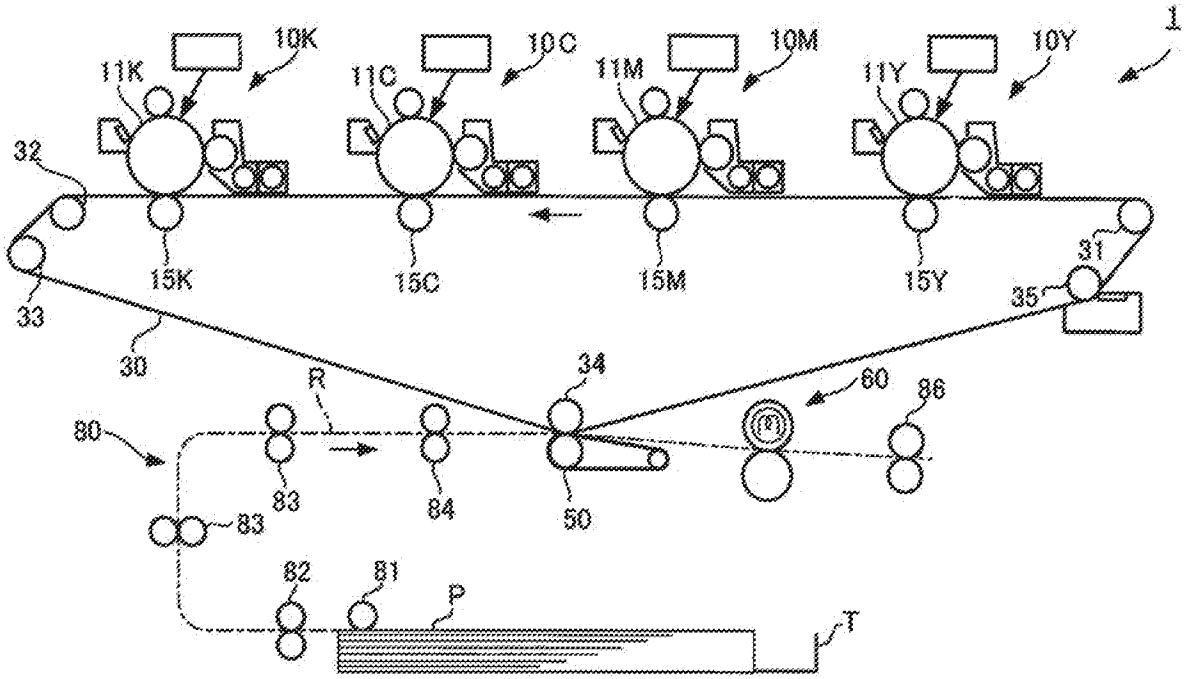
FIG. 1 is a schematic configuration diagram showing an image forming apparatus of a first exemplary embodiment.

FIG. 1 is a schematic configuration diagram showing an image forming apparatus of a first exemplary embodiment.

An image forming apparatus 1 shown in FIG. 1 is a so-called tandem color printer. A sheet P is used as a recording material in the image forming apparatus 1. Plastic paper or an envelope other than the sheet P may be employed as the recording material. In the following description, the sheet P is used as a representative of the recording material.

The image forming apparatus 1 includes four image engines 10Y, 10M, 10C, and 10K corresponding to four colors of, for example, yellow (Y), magenta (M), cyan (C), and black (K). In the present exemplary embodiment, each of the image engines 10Y, . . . , 10K forms a toner image by a so-called electrophotographic process. In each of the image engines 10Y, . . . , 10K, the toner image of each color is formed on a corresponding one of photoconductor drums 11Y, 11M, 11C, 1K by sequentially performing the steps of charging, exposure, and development.

The image forming apparatus 1 in the present exemplary embodiment employs an indirect transfer method, and includes an intermediate transfer belt 30. The image forming apparatus 1 also includes a secondary transfer unit 50, a fixing device 60, and a sheet transport unit 80.

The intermediate transfer belt 30 is an endless belt stretched over support rollers 31 to 35. The intermediate transfer belt 30 circulates counterclockwise through the image forming units 10Y, 10M, 10C, and 10K and the secondary transfer unit 50.

The image engines 10Y, . . . , 10K have primary transfer rollers 15Y, 15M, 15C, and 15K at positions where the primary transfer rollers 15Y, 15M, 15C, and 15K face the photoconductor drums 11Y, . . . 11K with the intermediate transfer belt 30 interposed therebetween. The primary transfer rollers 15Y, . . . , 15K cause the toner images on the photoconductor drums 11Y, . . . , 11K to be electrostatically attracted to the intermediate transfer belt 30 by receiving a voltage. The toner images of the colors formed by the image engines 10Y, . . . , 10K are sequentially transferred onto the intermediate transfer belt 30 in a superimposed manner by the primary transfer rollers 15Y, . . . , 15K. As a result of such transfer, a color image is formed on the intermediate transfer belt 30. The intermediate transfer belt 30 carries and moves the color image and transports the color image to the secondary transfer unit 50.

The secondary transfer unit 50 is provided such that the intermediate transfer belt 30 is interposed between the secondary transfer unit 50 and a backup roller 34 that is one of the support rollers 31 to 35. The secondary transfer unit 50 transfers the color image with the sheet P being interposed between the secondary transfer unit 50 and the intermediate transfer belt 30.

Sheets P are stored in a stacked state on a sheet tray T provided in a lower part of the image forming apparatus 1. The sheets P in the sheet tray T is taken out one by one from the sheet tray T by a feeding roller 81 provided in the sheet transport unit 80 and retard rollers 82, and is transported along a transport path R by transport rollers 83. Registration rollers 84 of the sheet transport unit 80 feed the sheet P to the secondary transfer unit 50 in accordance with timing of transporting the color image by the intermediate transfer belt 30.

As will be described in detail below, the secondary transfer unit 50 transfers the color image on the intermediate transfer belt 30 onto the sheet P by receiving a voltage. The secondary transfer unit 50 is an example of a belt driving device of the present disclosure, and is also an example of a transfer device of the present disclosure. The sheet P on which the color image is transferred by the secondary transfer unit 50 is transported to the fixing device 60 by the secondary transfer unit 50 and the transport rollers 83 of the sheet transport unit 80.

A combination of the image forming units 10Y, 10M, 10C, and 10K, the intermediate transfer belt 30, and the secondary transfer unit 50 corresponds to an example of an image forming unit according to the present disclosure. A combination of the secondary transfer unit 50 and the sheet transport unit 80 corresponds to an example of a transport unit according to the present disclosure.

The fixing device 60 fixes the color image on the sheet P by applying heat and pressure to the sheet P. The sheet P on which the color image is fixed by the fixing device 60 is fed to the outside of the image forming apparatus 1 by delivery rollers 86 provided in the sheet transport unit 80.

The secondary transfer unit 50 will be described in more detail below.

Figure 2:
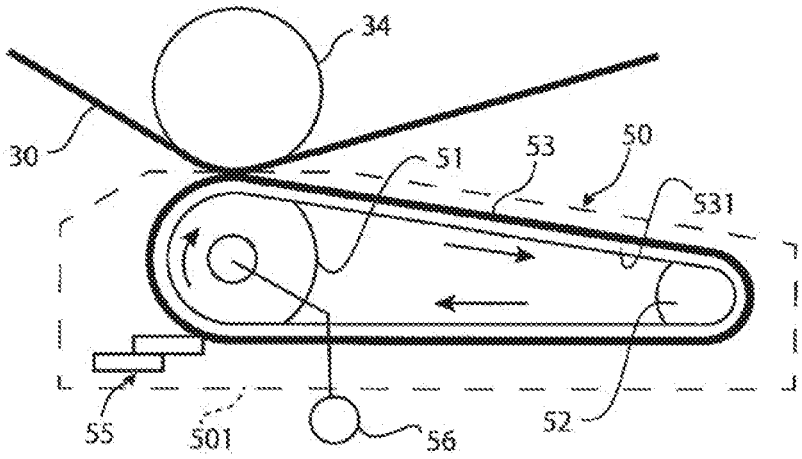
FIG. 2 is a side view schematically showing a structure of a secondary transfer unit.
Figure 3:
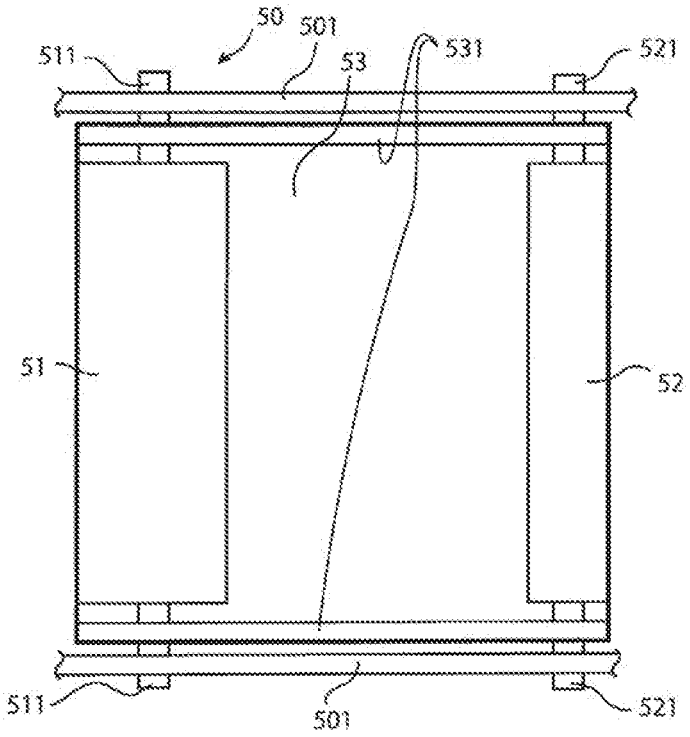
FIG. 3 is a top view schematically showing the structure of the secondary transfer unit.

FIGS. 2 and 3 are diagrams schematically showing a structure of the secondary transfer unit. FIG. 2 is a side view and FIG. 3 is a top view. For convenience of explanation, FIG. 3 shows the structure in which the inside of the secondary transfer unit is seen through.

The secondary transfer unit 50 includes a transfer roller 51, a separation roller 52, and an endless transfer belt 53 wound around the transfer roller 51 and the separation roller 52. The secondary transfer unit 50 is unitized by assembling elements in a transfer unit support frame 501. The transfer roller 51 and the separation roller 52 include rotation shafts 511 and 521. The rotation shafts 511 and 521 are rotatably supported by the transfer unit support frame 501. The transfer roller 51 and the separation roller 52 correspond to an example of plural rotary members of the present disclosure. The transfer belt 53 corresponds to an example of a belt member of the present disclosure.

The transfer roller 51 is driven by a transfer motor 56 to rotate clockwise to drive the transfer belt 53. The transfer belt 53 is a resin belt having low elasticity and circulates clockwise by receiving a driving force by the transfer roller 53.

The transfer roller 51 presses the transfer belt 53 against the intermediate transfer belt 30 from the inside of the transfer belt 53. When the sheet P is fed between the transfer belt 53 and the intermediate transfer belt 30 pressed against each other, the sheet P is transported in a circulation direction while being interposed between the transfer belt 53 and the intermediate transfer belt 30. The transfer roller 51 is connected to a power supply (not shown), and a transfer bias is applied to the transfer roller 51 from the power supply. By the action of the transfer bias, the color image on the intermediate transfer belt 30 is transferred onto the sheet P while the sheet P passes between the transfer belt 53 and the intermediate transfer belt 30.

The separation roller 52 is a roller having a diameter smaller than that of the transfer roller 51. Since the separation roller 52 abruptly bends a traveling direction of the transfer belt 53, a leading end of the sheet P placed on the transfer belt 53 is separated from the transfer belt 53. In the present exemplary embodiment, the separation roller 52 is shorter in length than the transfer roller 51 and rotates following movement of the intermediate transfer belt 30.

At edges of the transfer belt 53, resin ribs 531 are provided. The ribs 531 prevent the transfer belt 53 from falling off the transfer roller 51. The rib 531 protrudes inward from an inner peripheral surface of the transfer belt 53. The rib 531 extends in a movement direction of the transfer belt 53 along the edge of the transfer belt 53. The ribs 531 and the transfer roller 51 are arranged in an extending direction of the rotation shaft 511. The ribs 531 and the separation roller 52 are arranged in an extending direction of the rotation shaft 521. In the present exemplary embodiment, the ribs 531 are provided on both sides of the transfer belt 52 across the transfer roller 51 and the separation roller 52. The rib 531 corresponds to an example of a protrusion of the present disclosure.

The secondary transfer unit 50 includes a cleaning blade 55. An edge of the cleaning blade 55 is in contact with an outer peripheral surface of the transfer belt 53. A position of the cleaning blade 55 is fixed with respect to the transfer unit support frame 501. The edge of the cleaning blade 55 rubs against the outer peripheral surface of the transfer belt 53 with the movement of the transfer belt 53. The toner and other contaminants adhering to the transfer belt 53 are rubbed by the cleaning blade 55 and scraped off from the transfer belt 53.

Figure 4:
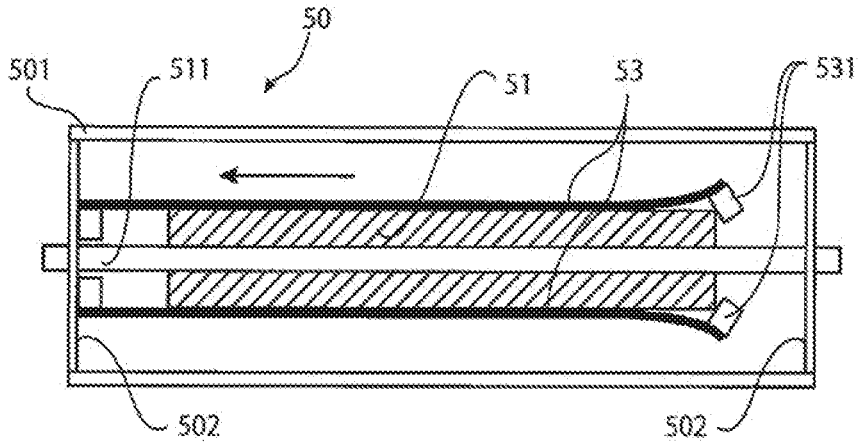
FIG. 4 is a cross-sectional view schematically showing a structure around a transfer roller.

FIG. 4 is a cross-sectional view schematically showing a structure around the transfer roller.

FIG. 4 shows the transfer roller 51 when viewed from the right in FIG. 2.

The transfer belt 53 is driven by the transfer roller 51 to circulate as described above. The transfer belt 53 may deviate, that is, so called "walk" may occur. Due to the walk, a traveling position of the transfer belt 53 during the circulation deviates in the extending direction of the transfer roller 51 intersecting with the circulation direction. FIG. 4 shows a state in which the transfer belt 53 deviates to the left side of the figure and comes close to one of walls 502 of the transfer unit support frame 501 supporting the rotation shaft 511.

When the transfer belt 53 deviates in this manner, the rib 531 comes into contact with the end portion of the transfer roller 51 to reduce the deviation. In a case where the transfer belt 53 largely deviates due to the walk, a part of the rib 531 may further ride on the end portion of the transfer roller 51 while being in contact with the end portion of the transfer roller 51. When the rib 531 rides on the transfer roller 51 in this manner, a force that pushes back the transfer belt 53 acts such that the traveling position of the transfer belt 53 returns toward a center of the transfer belt 53. When the rib 531 rides on the transfer roller 51, a strong bending stress or the like is applied to the transfer belt 53. Accordingly, the transfer belt 53 may be damaged when the rib 531 rides on the transfer roller 51 repeatedly.

When the rib 531 rides on the transfer roller 51 frequently, the edge of the cleaning blade 55 is pushed up, which may cause a cleaning failure.

In the present exemplary embodiment, a width of the transfer belt 53, that is, a size of the transfer belt 53 in the extending direction of the transfer roller 51, is slightly larger than a distance from the wall 502 to an end surface of the transfer roller 51 (hereinafter, the distance may be referred to as a "wall-end surface distance"). When the rib 531 rides on one side of the transfer belt 53 (for example, the right side of FIG. 4), the edge of the transfer belt 53 comes into contact with the wall 502 on the other side of the transfer belt 53. Since the contact between the transfer belt 53 and the wall 502 generates a force that returns the traveling position of the transfer belt 53 toward the center of the transfer belt 53, the transfer belt 53 is strongly returned by a synergistic effect of (i) the contact between the transfer belt 53 and the wall 502 and (ii) the riding of the rib 531 on the transfer roller 51. Accordingly, time during which the rib 531 rides on the transfer roller 51 is shortened, and damage to the transfer belt 53 due to the riding of the rib 531 is prevented.

When the width of the transfer belt 53 is smaller than the wall-end surface distance, the rib 531 completely rides on the outer peripheral surface of the transfer roller 51 before the edge of the transfer belt 53 comes into contact with the wall 502. That is, a difference between a position of the transfer belt 53 when the edge starts to come into contact with the wall 502 (hereinafter, the position may be referred to as a "wall contact position") and a position of the transfer belt 53 when the rib 531 starts to come into contact with the end surface of the transfer roller 51 (hereinafter, the position may be referred to as an "end surface contact position") is equal to or larger than the width of the rib 531, that is, equal to or larger than the size of the rib 531 in the extending direction of the transfer roller 51. For this reason, when the edge of the transfer belt 53 comes into contact with the wall 502, the effect of preventing the deviating of the transfer belt 53 by the rib 531 is lost, and the above-described synergistic effect is not obtained. Therefore, it is desirable that the width of the transfer belt 53 is larger than the wall-end surface distance, that is, the difference between the wall contact position and the end surface contact position is less than the width of the rib 531. Such a desirable width of the transfer belt 53 can be said to be a width that provides (i) the prevention of the deviating of the transfer belt 53 by the contact between the transfer belt 53 and the wall 502 and (ii) the prevention of the deviating of the transfer belt 53 by the contact between the rib 531 and the end portion of the transfer roller 51, simultaneously.

More specifically, in a case where the width of the transfer belt 53 is larger than the wall-end surface distance by more than half of the height of the rib 531, that is, by more than half of the amount by which the rib 531 protrudes from the transfer belt 53, the edge of the transfer roller 51 comes into contact with a leading end side riding over the half of the height of the rib 531 when the transfer belt 53 comes into contact with the wall 502. For this reason, the transfer belt 53 is strongly warped, and the force for the rib 531 to push back the transfer belt 53 is weak. Accordingly, it is considered that the synergistic effect of the above-described simultaneous preventions of the deviating is also weak. Therefore, it is desirable that the width of the transfer belt 53 is larger than the wall-end surface distance by half or less of the height of the rib 531.

The above-described arrangement relationship and size relationship among the transfer belt 53, the transfer roller 51, and the wall 502 are also true among the transfer belt 53, the separation roller 52, and the wall 502. It is assumed that the above-described simultaneous preventions of the deviating also occur among the transfer belt 53, the separation roller 52, and the wall 502.

Next, a second exemplary embodiment of the present disclosure will be described. The second exemplary embodiment is the same as the first exemplary embodiment except that the width of the transfer belt 53 is different. Accordingly, the description will be focused on differences from the first exemplary embodiment and a repetitive description will be omitted.

Figure 5:
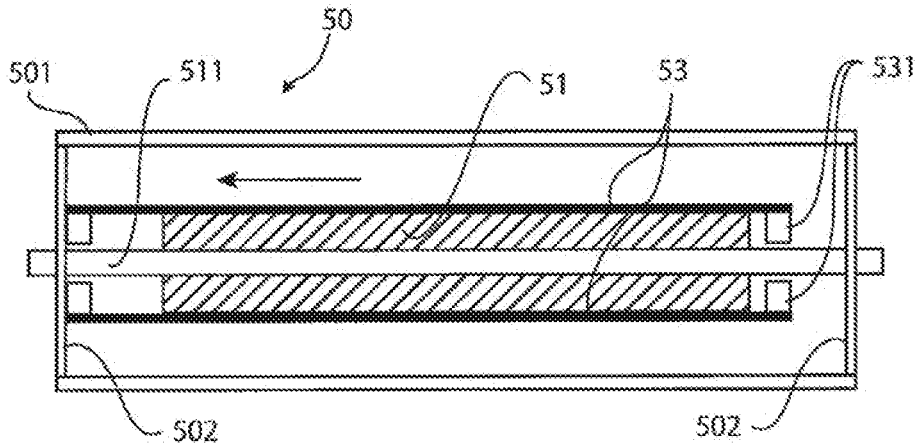
FIG. 5 is a cross-sectional view schematically showing a structure around a transfer roller according to a second exemplary embodiment.

FIG. 5 is a cross-sectional view schematically showing a structure around a transfer roller according to the second exemplary embodiment.

FIG. 5 shows the transfer roller 51 when viewed from the right in FIG. 2.

In the second exemplary embodiment, the width of the transfer belt 53 is larger than a wall-end surface distance by more than the width of the rib 531. As a result, the transfer belt 53 starts to come into contact with the wall 502 before the rib 531 comes into contact with an end surface of the transfer roller 51. Accordingly, the riding of the rib 531 itself is prevented, and the damage to the transfer belt 53 due to the riding of the rib 531 is further prevented than in the first exemplary embodiment.

If the width of the transfer belt 53 is too large, when the rib 531 comes into contact with the end surface of the transfer roller 51, the transfer belt 53 may be compressed on a side where the transfer belt 53 comes into contact with the wall 502, and a force for pushing back the transfer belt 53 may not be obtained. More specifically, if the difference between a wall contact position and an end surface contact position is equal to or less than the width of the rib 531, even when the rib 531 comes into contact with the end surface of the transfer roller 51, a reaction force for pushing back the transfer belt 53 is expected to be sufficiently generated by the contact with the wall 502 and a traveling position of the transfer belt 53 is expected to be returned toward the center of the transfer belt 53 by the synergistic effect. That is, if the difference between the wall contact position and the end surface contact position is equal to or less than the width of the rib 531, it is expected that the synergistic effect of the simultaneous preventions of the deviating described above is large.

Next, a third exemplary embodiment of the present disclosure will be described. The third exemplary embodiment is the same as the second exemplary embodiment except that the configuration of the wall 502 is different. Accordingly, the description will be focused on differences from the second exemplary embodiment and a repetitive description will be omitted.

Figure 6:
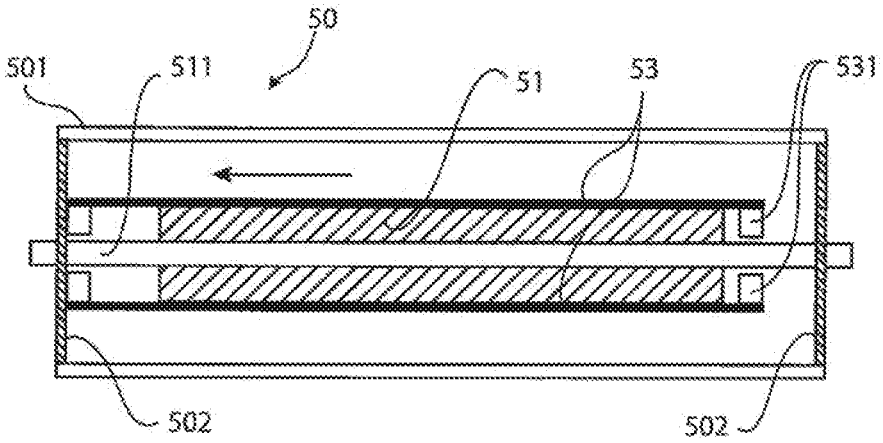
FIG. 6 is a cross-sectional view schematically showing a structure around a transfer roller according to a third exemplary embodiment.

FIG. 6 is a cross-sectional view schematically showing a structure around a transfer roller according to the third exemplary embodiment.

FIG. 6 shows the transfer roller 51 when viewed from the right in FIG. 2.

In the third exemplary embodiment, a material of the wall 502 that comes into contact with the transfer belt 53 has been subjected to a surface treatment using, for example, diamond like carbon, and has lower friction than another portion of the transfer unit support frame 501 that holds the wall 502. Since the wall 502 of such a material is provided in the third exemplary embodiment, even when the transfer belt 53 comes into contact with the wall 502, an amount of generated abrasion powder is small and the life of the transfer belt 53 is long.

Next, a fourth exemplary embodiment of the present disclosure will be described. The fourth exemplary embodiment is the same as the third exemplary embodiment except that the configuration of the wall 502 is different. Accordingly, the description will be focused on differences from the third exemplary embodiment and a repetitive description will be omitted.

Figure 7:
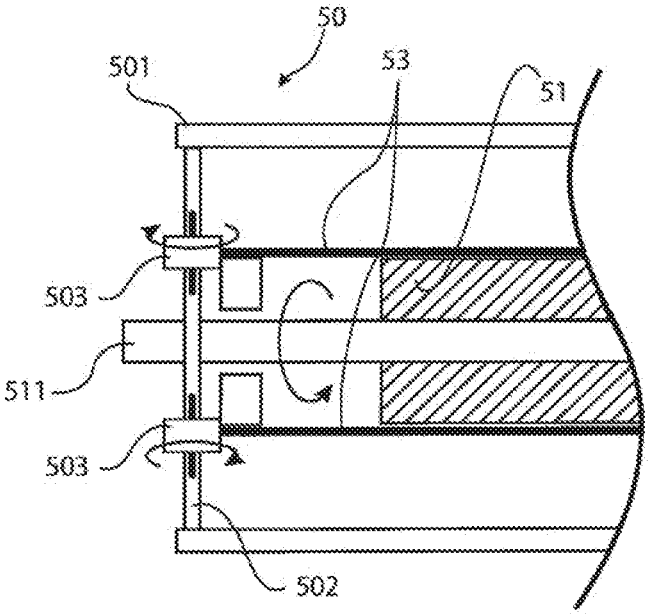
FIG. 7 is a cross-sectional view schematically showing a structure around an end of a transfer roller according to a fourth exemplary embodiment.

FIG. 7 is a cross-sectional view schematically showing a structure around an end of a transfer roller according to the fourth exemplary embodiment. FIG. 7 shows the transfer roller 51 when viewed from the right in FIG. 2.

In the fourth exemplary embodiment, in order to further reduce friction caused by contact between the transfer belt 53 and the wall 502, rotary members 503 are provided on the wall 502 at locations where the wall 502 comes into contact with the transfer belt 53. The transfer belt 53 comes into contact with peripheral surfaces of the columnar rotary members 503. Rotation shafts of the rotary members 503 extend along the wall 502. The rotary members 503 rotate following the movement direction of the transfer belt 53 due to the contact with the transfer belt 53. Accordingly, the friction caused by the contact between the transfer belt 53 and the wall 502 is greatly reduced, and an amount of generated abrasion powder is greatly reduced.

Figure 8:
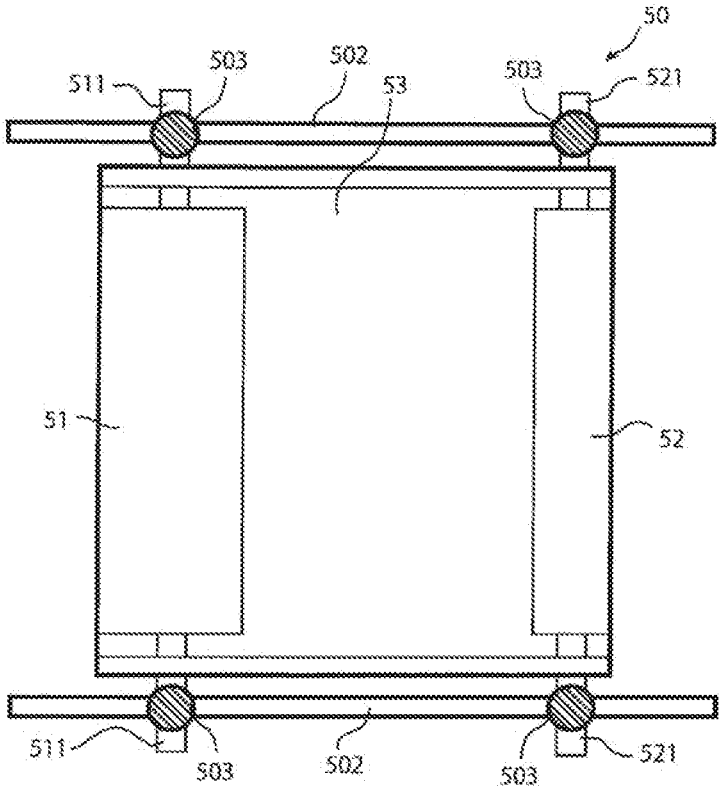
FIG. 8 is a diagram showing an installation location of a rotary member.

FIG. 8 is a diagram showing installation locations of the rotary members.

The rotary members 503 are provided at locations where a large force is applied when the transfer belt 53 comes into contact with the wall 502. Specifically, the large force is applied to locations where the transfer belt 53 starts and ends winding on the transfer roller 51 and the separation roller 52, by the contact with the wall 502. Therefore, as shown in FIG. 8, the rotary members 503 are provided at locations where the transfer belt 53 starts and ends winding on the transfer roller 51 and locations where the transfer belt 53 starts and ends winding on the separation roller 52. At the four locations shown in FIG. 8, as shown in FIG. 7, the rotary members 503 are provided at both upper and lower locations (that is, the back side and the front side in the direction perpendicular to the paper surface of FIG. 8) with the rotation shafts 511 and 521 of the transfer roller 51 and the separation roller 52 interposed therebetween. That is, in the example shown in FIG. 8, a total of eight rotary members 503 are provided.

Next, a fifth exemplary embodiment of the present disclosure will be described. The fifth exemplary embodiment is the same as the fourth exemplary embodiment except that the configuration of the rotary member is different. Accordingly, the description will be focused on differences from the fourth exemplary embodiment and a repetitive description will be omitted.

Figure 9:
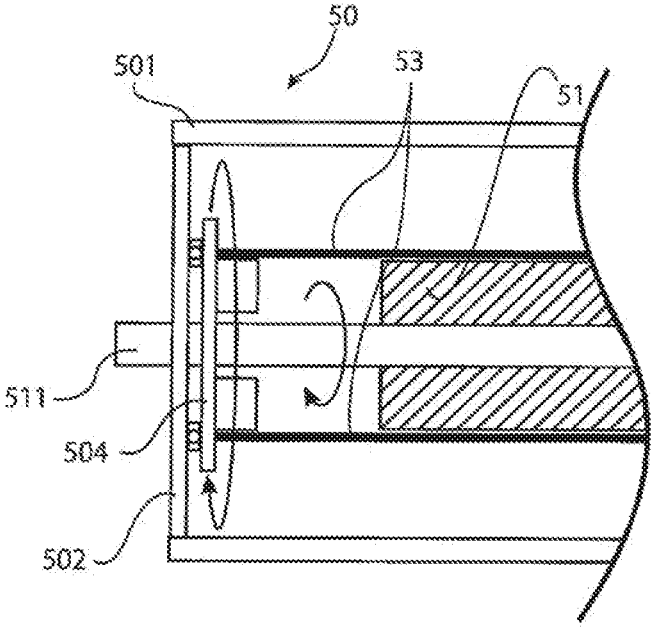
FIG. 9 is a cross-sectional view schematically showing a structure around an end of a transfer roller according to a fifth exemplary embodiment.

FIG. 9 is a cross-sectional view schematically showing a structure around an end of a transfer roller according to the fifth exemplary embodiment. FIG. 9 shows the transfer roller 51 when viewed from the right in FIG. 2.

In the fifth exemplary embodiment, a plate-shaped rotary member 504 is provided. The plate-shaped rotary member 504 is arranged coaxially with the transfer roller 51 and rotates separately from the transfer roller 51. The transfer belt 53 comes into contact with a planar surface of the rotary member 504, and the rotary member 504 rotates following the movement of the transfer belt 53. Even with such a rotary member 504, friction due to the contact between the transfer belt 53 and the wall 502 is greatly reduced, and an amount of generated abrasion powder is greatly reduced.

Next, a sixth exemplary embodiment of the present disclosure will be described. The sixth exemplary embodiment is the same as the fourth exemplary embodiment except that the configuration of a rotary member is different. Accordingly, the description will be focused on differences from the fourth exemplary embodiment and a repetitive description will be omitted.

Figure 10:
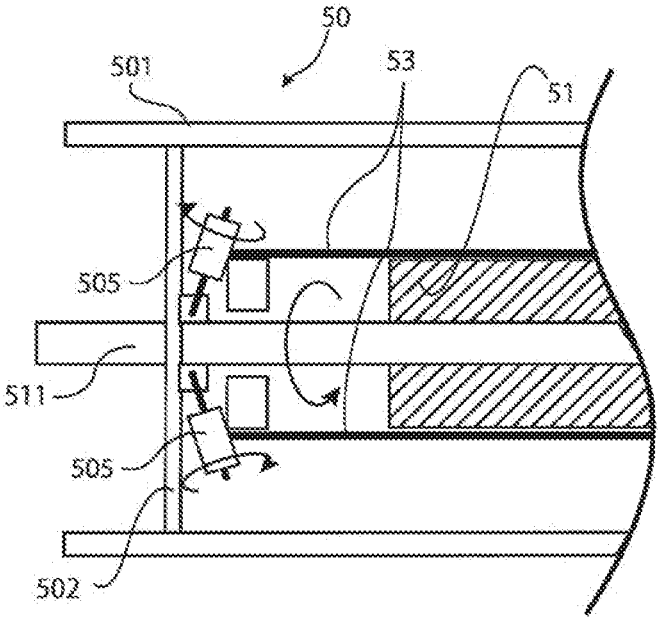
FIG. 10 is a cross-sectional view schematically showing a structure around an end of a transfer roller according to a sixth exemplary embodiment.

FIG. 10 is a cross-sectional view schematically showing a structure around an end of the transfer roller according to the sixth exemplary embodiment. FIG. 10 shows the transfer roller 51 when viewed from the right in FIG. 2.

In the sixth exemplary embodiment, rotary members 505 whose rotation shafts are inclined with respect to the wall 502 are provided. A peripheral surface of the rotary member 505 in the sixth exemplary embodiment also comes into contact with the transfer belt 53 and rotates following the movement of the transfer belt 53. Since the rotation shaft of the rotary member 505 in the sixth exemplary embodiment is inclined, the transfer belt 53 is pushed inward due to the contact with the transfer belt 53. As a result, a traveling position of the transfer belt 53 is guided toward the center of the transfer belt 53. Since a force required for such guidance is smaller than a contact force in a case where the rotation shaft of the rotary member 505 is not inclined, load on the transfer belt 53 due to the change in the traveling position is small.

Next, a seventh exemplary embodiment of the present disclosure will be described. The seventh exemplary embodiment is the same as the sixth exemplary embodiment except that the configuration of a rotary member is different. Accordingly, the description will be focused on differences from the sixth exemplary embodiment and a repetitive description will be omitted.

Figure 11:
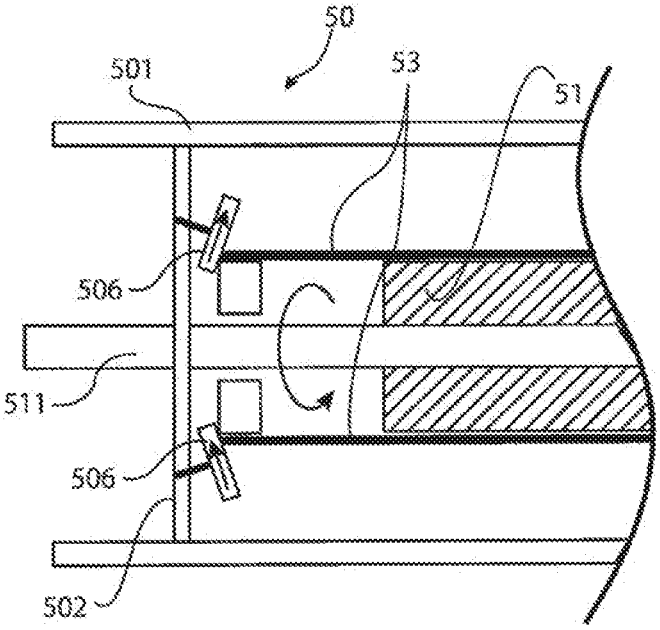
FIG. 11 is a cross-sectional view schematically showing a structure around an end of a transfer roller according to a seventh exemplary embodiment.

FIG. 11 is a cross-sectional view schematically showing a structure around an end of the transfer roller according to the seventh exemplary embodiment. FIG. 1I shows the transfer roller 51 when viewed from the right in FIG. 2.

In the seventh exemplary embodiment, rotary members 506 whose rotation shafts are inclined with respect to the wall 502 are provided. The rotary member 506 according to the seventh exemplary embodiment has a disk shape and comes into contact with the transfer belt 53 on a flat surface of the disk. In the seventh exemplary embodiment, the transfer belt 53 is pushed inward by the inclined disk surface, and a traveling position of the transfer belt 53 is guided toward the center of the transfer belt 53.

Next, an eighth exemplary embodiment of the present disclosure will be described. The eighth exemplary embodiment is the same as the sixth exemplary embodiment except that the configuration of a rotary member is different. Accordingly, the description will be focused on differences from the sixth exemplary embodiment and a repetitive description will be omitted.

Figure 12:
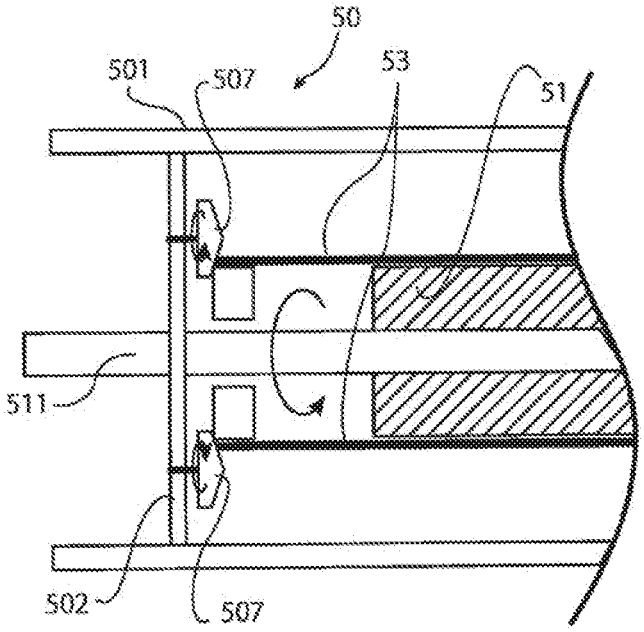
FIG. 12 is a cross-sectional view schematically showing a structure around an end of a transfer roller according to an eighth exemplary embodiment.

FIG. 12 is a cross-sectional view schematically showing a structure around an end of the transfer roller according to the eighth exemplary embodiment. FIG. 12 shows the transfer roller 51 when viewed from the right in FIG. 2.

In the eighth exemplary embodiment, rotary members 507 having rotation shafts projecting perpendicularly from the wall 502 are provided. The rotary member 507 has an umbrella-shaped rotary surface. The rotary surface is inclined with respect to the wall 502. The rotary member 507 comes into contact with the transfer belt 53 on the umbrella-shaped rotary surface to push the transfer belt 53 inward. As a result, in the eighth exemplary embodiment, a traveling position of the transfer belt 53 is guided toward the center of the transfer belt 53.

In the above description, the examples are shown in which the protrusions of the present disclosure are provided on both edges of the belt member of the present disclosure. Alternatively, when the walk tends to be strong on only one side, the protrusion of the present disclosure may be provided, for example, on only one side of the belt member.

The above description shows the examples in which the belt driving device of the present disclosure is applied to the transfer device. Alternatively, the belt driving device of the present disclosure may be applied to a unit that drives the intermediate transfer belt or a device that drives the sheet transport belt.

In the above description, the color printer is shown as an exemplary embodiment of the image forming apparatus of the present disclosure. Alternatively, the image forming apparatus of the present disclosure may be a monochrome printer, or may be a copier, a facsimile, or a multifunction device.

In the above exemplary embodiments, the electrophotographic image forming apparatuses have been described as examples. It is noted that the present disclosure is applicable to transfer devices and image forming apparatuses that are of types other than the electrophotographic type. For example, the present disclosure may be applied to an inkjet image forming apparatus. Specifically, the present disclosure may be applied to an image forming apparatus that draws an ink image on an intermediate transfer body using an ink ejection head and transfers the ink image from the intermediate transfer body onto a sheet. As in the electrophotographic image forming apparatus, the inkjet image forming apparatus reduces impact and wind pressure from a sheet and prevents ink from spattering and moving on the intermediate transfer body.

The present disclosure may be applied to an image forming apparatus of another type so long as the image forming apparatus transfers an image onto a recording material.

The present disclosure may be applied to a belt member, other than a transfer belt, in an image forming apparatus. For example, the present disclosure may be applied to a transport device between a transfer device and a fixing device.

The present disclosure may be applied to a belt driving device other than an image forming apparatus.

The present disclosure is made for the purpose of addressing the problems described in the "SUMMARY" section. It is noted that the configurations of the present disclosure are not prevented from being diverted to other purposes in a form that does not address the problem. A form in which any of the configurations of the present disclosure is diverted in this manner is also an exemplary embodiment of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A belt driving device comprising:

an annular belt member comprising a first edge and a second edge;

a plurality of rotary members that extend in parallel and rotate, the belt member being wound around the rotary members, the belt member circulating;

a protrusion that protrudes from an inner peripheral surface of the belt member, the protrusion extending along the second edge of the belt member, the protrusion being arranged in a direction parallel to an extending direction of the rotary members, the protrusion being provided at the second edge; and a contact member that is closer to the first edge than the second edge, the contact member and the belt member being arranged side by side, wherein when the belt member deviates in the extending direction, the contact member comes into contact with the belt member to limit the deviating of the belt member, and a difference between a position of the belt member when the protrusion comes into contact with an end surface of one of the rotary members and a position of the belt member when the belt member comes into contact with the contact member is equal to or less than a width of the protrusion in the extending direction.

2. The belt driving device according to claim 1, wherein the difference between the position of the belt member when the protrusion comes into contact with the end surface of the one of the rotary members and the position of the belt member when the belt member comes into contact with the contact member is equal to or less than half of a height of the protrusion.

3. The belt driving device according to claim 2, wherein the contact member comprises a contact surface where the contact member comes into contact with the belt member, and the contact surface is inclined with respect to the extending direction.

4. The belt driving device according to claim 3, wherein the contact member comprises a columnar rotary body that has a rotation shaft extending in a direction along the contact surface that is a peripheral surface thereof.

5. The belt driving device according to claim 1, wherein the contact member comes into contact with the belt member before the protrusion comes into contact with the end surface of the one of the rotary members.

6. The belt driving device according to claim 5, wherein the contact member comprises a contact surface where the contact member comes into contact with the belt member, and the contact surface is inclined with respect to the extending direction.

7. The belt driving device according to claim 6, wherein the contact member comprises a columnar rotary body that has a rotation shaft extending in a direction along the contact surface that is a peripheral surface thereof.

8. The belt driving device according to claim 1, wherein at least a portion of the contact member where the contact member comes into contact with the belt member is formed of a material having a lower frictional resistance than another member that holds the contact member.

9. The belt driving device according to claim 1, wherein the contact member comprises a rotary body whose contact surface moves in a movement direction of the belt member as the contact member contacts with the belt member.

10. The belt driving device according to claim 9, wherein the rotary body comprises a columnar member that has a rotation shaft extending parallel to a direction along the contact surface that is a peripheral surface.

11. The belt driving device according to claim 9, wherein the rotary body comprises a plate-shaped member that has a rotation shaft extending in a direction intersecting the contact surface that is a flat surface.

12. The belt driving device according to claim 1, wherein the contact member comprises a contact surface where the contact member comes into contact with the belt member, and the contact surface is inclined with respect to the extending direction.

13. The belt driving device according to claim 12, wherein the contact member comprises a columnar rotary body that has a rotation shaft extending parallel to a direction along the contact surface that is a peripheral surface thereof.

14. The belt driving device according to claim 12, wherein the contact member comprises a plate-shaped rotary body having a rotation shaft extending in a direction intersecting the contact surface that is a flat surface.

15. A belt driving device comprising:

an annular belt member comprising a first edge and a second edge;

a plurality of rotary members that extend in parallel and rotate, the belt member being wound around the rotary members, the belt member circulating;

a protrusion that protrudes from an inner peripheral surface of the belt member, the protrusion extending along the second edge of the belt member, the protrusion being arranged in a direction parallel to an extending direction of the rotary member, the protrusion being provided at the second edge; and a contact member that is closer to the first edge than the second edge, the contact member and the belt member being arranged side by side, wherein when the belt member deviates in the extending direction, the contact member comes into contact with the belt member to limit the deviating of the belt member, and the belt member has a size such that prevention of the deviating of the belt member by the protrusion being in contact with an end surface of one of the rotary members and the prevention of the deviating of the belt member by the belt member being in contact with the contact member occur simultaneously.

16. The belt driving device according to claim 15, wherein the contact member comprises a contact surface where the contact member comes into contact with the belt member, and the contact surface is inclined with respect to the extending direction.

17. The belt driving device according to claim 16, wherein the contact member comprises a columnar rotary body that has a rotation shaft extending in a direction along the contact surface that is a peripheral surface thereof.

18. A transfer device comprising:

an annular belt member comprising an outer peripheral surface, a first edge, and a second edge, the annular belt member being configured to transfer an image onto a recording material by (i) the outer peripheral surface coming into contact with the recording material and (ii) receiving a voltage;

a plurality of rotary members that extend in parallel and rotate, the belt member being wound around the rotary members, the belt member circulating;

a protrusion that protrudes from an inner peripheral surface of the belt member, the protrusion extending along the second edge of the belt member, the protrusion being arranged in a direction parallel to an extending direction of the rotary members, the protrusion being provided at the second edge; and a contact member that is closer to the first edge than the second edge, the contact member and the belt member being arranged side by side, wherein when the belt member deviates in the extending direction, the contact member comes into contact with the belt member to limit the deviating of the belt member, and a difference between a position of the belt member when the protrusion comes into contact with an end surface of one of the rotary members and a position of the belt member when the belt member comes into contact with the contact member is equal to or less than a width of the protrusion in the extending direction.

* * * * *